United States Patent [19]

Coleman

[11] 4,445,559

[45] May 1, 1984

[54] WATER FOG-TYPE ASH PRECIPITATOR FOR A KILNED LUMBER PILE BREAKDOWN HOIST

[75] Inventor: Cecil A. Coleman, Thomasville, Ga.

[73] Assignee: Balfour Lumber Company, Thomasville, Ga.

[21] Appl. No.: 485,895

[22] Filed: Apr. 18, 1983

[51] Int. Cl.[3] ..... F26B 9/12; F26B 7/00

[52] U.S. Cl. ..... 144/363; 34/13.4; 144/380; 432/18

[58] Field of Search ..... 432/2, 18, 85; 34/13, 34/13.4, 13.8, 60, 236; 144/363, 364, 380

[56] References Cited

U.S. PATENT DOCUMENTS

| | | | |
|---|---|---|---|
| 1,420,976 | 6/1922 | Dickerson | 144/3 R |
| 1,795,953 | 3/1931 | Johnson | 144/1 R |
| 3,276,492 | 10/1966 | Kervefors | 144/3 R |
| 4,167,961 | 9/1979 | Paris | 144/3 R |
| 4,343,607 | 8/1982 | Coleman | 432/18 |

*Primary Examiner*—W. D. Bray

*Attorney, Agent, or Firm*—Cushman, Darby & Cushman

[57] ABSTRACT

A breakdown hoist is located in a timber processing operation between a direct-fired ash-producing combustor for generating the heated gas stream for kilning a pile of lumber and the feed for a downstream operation such as sorting, grading, trimming and/or packaging, with or without planing. At the hoist, the kilned lumber is progressively destacked in a tilting, sliding and tumbling operation which results in the shunting-aside of spacer sticks, and conversion of the pile into a single layer of lumber progressing along on a feeding deck toward the downstream operation. A fog cloud of water droplets is sprayed obliquely downwards towards downstream from about 3 to about 9 feet above where the breakdown hoist adjoins the upstream end of the feeding deck, at approximately parallel to the top course on the pile. The fog cloud spreads out to envelope the feeding deck. As the kilned lumber tumbles from the top of the pile and ash particles are shaken off and become airborne, they become wetted by water droplets from the fog cloud and settle to the floor. This settling takes place primarily around the breakdown hoist and planer infeed decks. Periodically the floor is cleaned to gather the precipitated ash. The lumber itself is transported along the line without having become substantially wet and, generally, is ready for immediate packaging upon reaching the packaging station.

5 Claims, 1 Drawing Figure

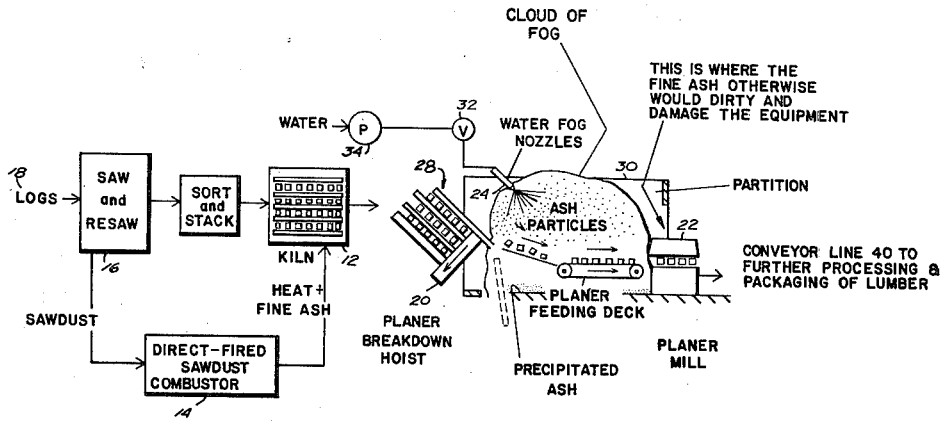

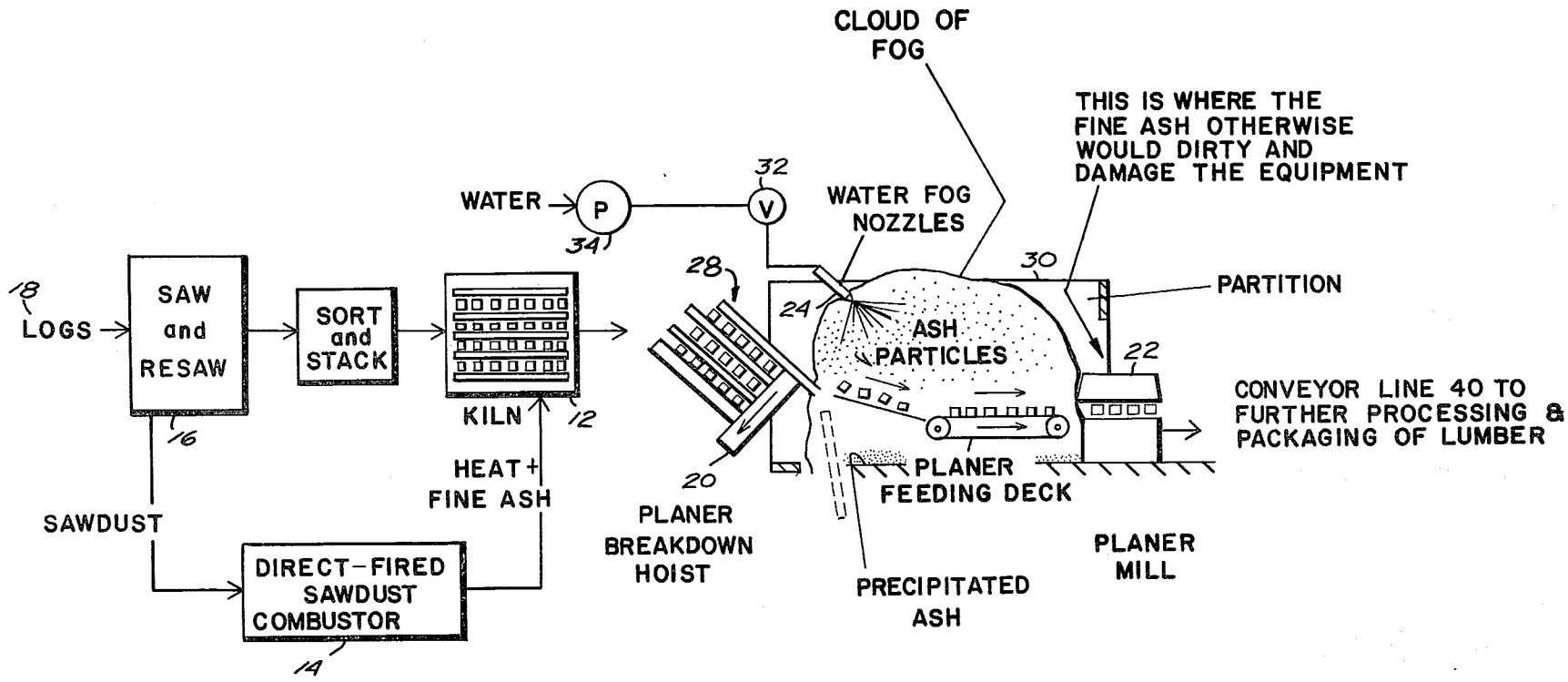
THIS IS WHERE THE FINE ASH OTHERWISE WOULD DIRTY AND DAMAGE THE EQUIPMENT
PARTITION
CONVEYOR LINE 40 TO FURTHER PROCESSING & PACKAGING OF LUMBER
PLANER MILL
22
30
CLOUD OF FOG
WATER FOG NOZZLES
ASH PARTICLES
PLANER FEEDING DECK
PRECIPITATED ASH
24
32
V
28
20
PLANER BREAKDOWN HOIST
P
34
WATER
12
KILN
HEAT + FINE ASH
SORT and STACK
DIRECT-FIRED SAWDUST COMBUSTOR
14
SAW and RESAW
16
SAWDUST
18
LOGS

WATER FOG-TYPE ASH PRECIPITATOR FOR A KILNED LUMBER PILE BREAKDOWN HOIST

BACKGROUND OF THE INVENTION

In my earlier U.S. Pat. No. 4,343,607, issued Aug. 10, 1982, I described a spray system for a kilned lumber pile breakdown hoist.

More of the background and a brief summary of the prior invention now patented in U.S. Pat. No. 4,343,607 are contained in Griffin, "Combustor Adapted to Direct Fire Kilns", Timber Processing Industry, Aug. 1980, front cover and pp 10–12 and 14.

Until shortly prior to the filing of the U.S. patent application which matured as U.S. Pat. No. 4,343,607, as is stated in the specification of that patent, it was the almost unexceptional practice to dry lumber after sawing, using the burning of fossil fuel, particularly natural gas to create the necessary heated-gas stream for circulation through the kiln. Various proposals had been made and tried for direct-fired combustors using wood waste, particularly sawdust, as fuel, but incompleteness of combustion has always represented a difficult problem. Lately, as the cost of petroleum has risen, the desire to switch to sawdust as fuel for heating the lumber kiln gas stream has become irresistible. Fortunately, there have been a number of improvements made in combustors in recent years, e.g. the development of fluidized-bed combustion techniques, so that it is now reasonable to burn sawdust, or a mixed fuel largely consisting of sawdust, to produce the heated dry gas stream for kilning lumber.

One unavoidable product of the combustion of sawdust is ash: fine particulate material consisting of that which would not or did not burn completely and that which when burned remained or produced a solid. Under most operating conditions, the great bulk of the ash will fail to become entrained in the heated gas stream, and if so-entrained, will be removed in the bag house filters or the multiclone filters on the upstream side of the kiln. However, a certain amount of the particulates cannot be removed by the filters and will be carried through the kiln in the heated gas stream. Some of this will silt-out within the kiln and will deposit on the lumber being kilned.

Typically, within a modern lumber kiln, a multi-course pile of lumber is subjected as a unit to the heated gas stream. In order to ensure even and thorough treatment the various courses are stacked with the aid of spacing courses—each being an open layer comprising a few sticks placed crosswise to the direction of the lengths of lumber in the immediately subjacent and superjacent courses.

Accordingly, as the stacked lumber is being kilned in a direct-fired sawdust fueled combustor, one can expect the pile of lumber exiting the kiln to bear a deposit of fine ash not just on the outer, upper or exposed lengths in the pile, but throughout the pile, potentially on every piece in each course.

A piece of apparatus has been developed and become widely used for converting the pile of kilned lumber into a single layer of uniformly oriented lengths for further processing, e.g. for planing. One type of such controlled destacking apparatus is known as a breakdown hoist.

At a breakdown hoist, one lateral side of the pile of kilned lumber is supported using a weir-like wall means along the full height of the pile and then the pile and wall are tilted so that all courses are supported against this wall. Next the wall is gradually lowered relative to the tilted stack so that support is serially withdrawn from first the upper course of lumber, then from the layer of spacer sticks which immediately underlaid that layer, and so on. Usually, this relative lowering is effected by raising the stack relative to the wall, so that the site where the layers become unsupported remains stationary. Immediately downstream of the site where the uppermost layer of lumber in the tilted pile becomes exposed on its downward-tilted side, there is provided a feeding deck, which may take the form of an inclined set of rails or the like leading down to a conveyor. Usually, this conveyor is the feed conveyor for a further processing station, e.g. a planer mill. A provision is generally made so that each layer of the spacer sticks as it becomes exposed falls down between the tilted stack and the feeding deck, and each layer of kilned lumber as it becomes exposed tumbles down the incline and onto the feed conveyor.

Where an ash-producing direct fired combustor has been used to kiln the lumber, this operation of destacking by tilting, sliding and tumbling is accompanied by the billowing-up of clouds of ash as it is violently shaken-free of the kilned lumber and spacer sticks. And that which remains on and around the lumber entering the planer mill acts as an abrasive on the moving and cutting parts, so that the bearings, planer knives and the like become worn and dull at an excessive rate.

According to my aforesaid prior patented invention, the ash was kept from becoming an airborne irritant, by spraying the upper face of the pile as it was being destacked, with sufficient water to wet-down the ash. As to each course in the pile, the wetting down was completed before that course slid or tumbled from the pile onto the feeding deck.

When the aforesaid earlier invention was made, the usual practice was to run the kilned rough lumber through a planer mill and possibly through other downstream finishing operations while it remained exteriorly wetted by the spray. In the course of conducting these finishing operations, a substantial portion of the wetted superficial portion of the lumber was cut or worn away, and due to the frictional heat generated in the finishing process, much of the rest of the moisture which had soaked into the lumber simply evaporated. To the extent that the finished lumber was still damp, it could be stacked with spacers and dried or permitted to dry.

While the invention works very well when the lumber is to be finished according to the process just outlined, in recent times, what has grown to be a substantial portion of the kilned lumber is not going to be immediately completely finished following destacking onto the feeding deck. Instead, much of it is to be sorted, graded, cut to length if necessary, and packaged for shipment, most frequently for export by ship. Often this lumber is not to be planed in the course of its transit from the feeding deck to the packaging station. Accordingly, if the lumber were wetted-down as it was destacked onto the feeding deck, it would remain wet at the packaging station. If packaged wet, the lumber would be prone to suffer excessive mildew and mold damage during shipment.

Accordingly, I have rethought my prior invention and have devised a way to abate the kiln ash problem without substantially wetting the lumber, and at a cost comparable to that of establishing and running the process of my prior invention.

SUMMARY OF THE INVENTION

A breakdown hoist is located in a timber processing operation between a direct-fired ash-producing combustor for generating the heated gas stream for kilning a pile of lumber and the feed for a downstream operation such as sorting, grading, trimming and/or packaging, with or without planing. At the hoist, the kilned lumber is progressively destacked in a tilting, sliding and tumbling operation which results in the shunting-aside of spacer sticks, and conversion of the pile into a single layer of lumber progressing along on a feeding deck toward the downstream operation. A fog cloud of water droplets is sprayed obliquely downwards towards downstream from about 3 to about 9 feet above where the breakdown hoist adjoins the upstream end of the feeding deck, at approximately parallel to the top course on the pile. The fog cloud spreads out to envelope the feeding deck. As the kilned lumber tumbles from the top of the pile and ash particles are shaken off and become airborne, they become wetted by water droplets from the fog cloud and settle to the floor. This settling takes place primarily around the breakdown hoist and planer infeed decks. Periodically the floor is cleaned to gather the precipitated ash. The lumber itself is transported along the line without having become substantially wet and, generally, is ready for immediate packaging upon reaching the packaging station.

The principles of the invention will be further discussed with reference to the drawing wherein a preferred embodiment is shown. The specifics illustrated in the drawings are intended to exemplify, rather than limit, aspects of the invention as defined in the claims.

BRIEF DESCRIPTION OF THE DRAWING

In the Drawing

The FIGURE is a schematic flow diagram of a timber processing system using the water fog-type ash precipitator for a kilned lumber pile breakdown hoist in accordance with principles of the present invention.

DETAILED DESCRIPTION OF THE PRESENTLY PREFERRED EMBODIMENT

The exemplary timber processing line 10 illustrated in the drawing is one that is in operation at Balfour Lumber Co., Thomasville, Ga., U.S.A. The mill is equipped for producing over 40MMBF annually of high grade pine boards; dimension lumber; and sorted, graded, cut to length and packaged rough lumber.

Two high temperature kilns here typified by the unit 12 are served by a York-Shipley fluidized bed solid fuel combustor 14 rated at 26 million BUT/hr., and designed to use green wood residue, e.g. sawdust as fuel. Combustion is continuous and self-sustaining on wood alone after a brief start-up with oil- or gas-fired ignition.

Sawdust for the combustor is collected in an adjacent 11,050 cu. ft. storage silo that is fed by a Rader pneumatic system extending from the sawmill. Automatic controls powered by a DC motor supply sawdust to the combustor based on heat variation within the unit. Simply described, the York-Shipley unit utilizes a 3 ft.-thick bed of sand that is preheated to 750° by a gas blower. At that temperature, sawdust is fed into the bed from above and the combustible type flame reaches an operating temperature of 1500°–1700°. Some 5 tons of sawdust is consumed per hour at maximum operation, approximately a third of which is burned in the sand and the remainder in the vapor space developed above the sand. A Zurn multi-cone ash collector removes about a barrel of ash from the system every 24 hours to hold the system within federal air pollution standards.

The kilns are direct fired, i.e. heated gas stream produced by combustion of the sawdust fuel is fed into the kilns where it comes in direct contact with the green lumber in order to dry and cure the lumber.

Some modification of the usual sawing operation 16 is needed in order to produce optimum-quality sawdust for the combustor 14; water application to the saws in the mill is reduced in order to lower sawdust moisture content to 55 percent; the kilns are provided with pressure vents and maintained under positive pressure during firing. Cycle time is about 17 hours for a kiln-load of 4/4 and about 22 hours for a kiln-load of 7/4.

The two kilns 12 are started-up on a staggered basis, with the first one being fired for up to 3 hours prior to starting the second. Typically, the kiln 12 may be a Moore-Memphis kiln having outside fan motors in order to eliminate motor burn-up.

In the particular mode disclosed, the mill 10 is a 7 ft. band mill operation designed for one-pass handling of small logs. Treelength logs 18 are delivered to the band mill, indicated at 16. The band mill has 2 infeed decks, one for treelengths and the other multiple lengths, and a pair of kickout bins enabling material delivered treelength to be bucked. The band mill concentrates on grade production.

A model 72-51B Terex front loader is assigned treelength unloading/deck supply duties and a model 72-21B Terex handles multiple lengths. The treelength deck is manned by a Prentice 600 k-boom that sorts and places stems onto the conveyor. The shortlog deck is live with stop-and-loader. Treelengths are sized with an 84 in. circle saw and the bolts combined with multiple lengths for processing through a 36 in. Passavant debarker.

A single deck at the mill entrance supplies bolts to a 7 ft. Filer & Stowell band equipped with a 3-block carriage and 10 in. Gardner watergun feed, and teamed with a CM&E slabbing chipper. Usual sawing pattern is for the sawyer to make a single pass on any bolt 6 in. and below and immediately dump it to a 7 ft. Filer & Stowell linebar resaw. The resulting 2-sided cant is sent across to a 10 in. Schurman double arbor, combination gang. A 2-saw Schurman edger is mounted downstream for re-edging pieces from the gang and the resaw.

The headrig sawyer opens 2 faces on bolts 8 in. and larger. Boards are removed from alternate sides until the cant can be run through the 10 in. Schurman combination gang. Extra large logs are double-cut for processing at the gang.

From the landing table, lumber travels through a HEMCO unscrambler and across to a separate "trimroom" equipped with a Brewster 9-unit, dropsaw trimmer. Also extending from the mill floor is a timbers dock equipped with a Prentice H Series k-boom. By-products from both the infeed line and the mill floor are relayed by a 220 ft. Rexnord vibrating conveyor to a Precision 66 in., 8-knife chipper. Sawdust from the mill floor is screened through the vibrating conveyor and picked up by a screw conveyor and relayed by a Rader pneumatic system to the combustor silo. Trim room sawdust is also relayed back to the Rader system.

From the trimmer, lumber travels down a Moseley slot-type sorter where some 50 separations are made. Everything is sent through the sorter except timbers, and with exceptions in the latter, 20 ft. is maximum length processed. Grades include: 4/4 in No. 3, No. 2, D and C & Better; 2×4's in No. 3, No. 2, No. 2 dense, No. 1 dense, and in 2×6's, a dense and select structural; 2×8's in No. 3, No. 2, No. 1 dense, and No. 1 dense select; 2×10's in No. 3, No. 2 and No. 1 dense; and 2×12's in No. 2, No. 3 and No. 1. Shipments are both rough and dressed. Specialty runs include flooring, siding, and even a beaded ceiling run that is a popular export item.

Planer mill machinery is highlighted by a Moore-Jacksonville breakdown hoist 20 and a Yates American A-20-12 planer 22 with 8 and 10 knife heads. Maximum output is about 400 rpm.

The lumber recovered from the dry kilns 12 is commonly covered with a coat of ash that if riled into the air at the breakdown hoist becomes an eye irritant and a nuisance at the planer 22.

Mounted above the breakdown hoist in the same vicinity as the spray structure disclosed in my aforesaid earlier U.S. patent, is a series of water atomization nozzles 24. However, instead of being aimed at the top course 28 of the stacked lumber on the breakdown hoist 20, the nozzles 24 are aimed longitudinally downstream, at a declining angle of about forty-five degrees to horizontal, i.e. approximately parallel to the plane of the top course.

Typically, there are four nozzles 24, spaced approximately equally apart along the width of the interface between the breakdown hoist 20 and the feeding deck 26. This interfacial region may be bounded at the left and right, and elsewhere to the extent considered necessary by partitions 30 for the purpose of physically confining the site where the process of the invention is conducted.

The fog nozzles 24 preferably are Bete (brand), fine atomization nozzles, model PTS, supplied by Bete Fog Nozle, Inc. of Greenfield, Mass., U.S.A. These nozzles each provide a ninety-degree fog pattern ranging from 0.32 gallons per minute at 60 p.s.i. to 1.36 gallons per minute at 1000 p.s.i. Accordingly, the control system for the water supply to the nozzles 24 preferably includes valve means 32 and a variable speed pump 34, which may be turned off when not needed.

Typically, the process of the invention is operated by the planer feederman. About a minute or so before lumber is going to be tilted and dropped from the pile at 28 onto the feeder deck 26, the operator turns on the fog system. A fog cloud 36 is generated by the nozzles 24 and spreads to envelope the region where the top course 28 falls, and the feeder deck 26. The fog cloud 36 is laterally confined by the partitions 30. The cloud 36 coalesces and settles to the floor under the hoist 28 and feeding deck 26.

As the lumber in the top course 28 falls, a considerable amount of ash is jarred-off and becomes airborne within the cloud of fog 36. Water droplets of the fog cloud wet, adhere to or are absorbed on the ash, causing it to precipitate onto the floor under the cloud. Periodically, e.g. weekly, the floor area in this vicinity is swept in order to recover and dispose of the precipitated ash.

Operation of the fog system is varied depending on observed conditions. The planer feederman operating the system may turn the water pumping pressure up or down as needed in order to cause the fog cloud to envelope the airborne ash particles. The fog system is run continuously while lumber is being destacked using the breakdown hoist 20, and is turned-off after the last course has been dropped. Should there be an interruption in lumber processing for more than a minute or two, it is easy for the operator to turn the fog system down or off until lumber processing is to be restarted.

Preferably the system of the present invention is installed as a parallel to the system of my aforementioned earlier U.S. Pat. No. 4,343,607, so that either system may be used and so that both could be used simultaneously. Generally, the prior system might be used where the lumber being processed is going to be planed, and the new fog system would be used where the lumber being processed is not going to be planed, or will be lightly planed. Rarely would both systems be used simultaneously as presently envisioned; however, the new fog system may be used instead of the old water spray system even where the lumber is to be planed.

The prior system and the new fog system cost approximately equal amounts to operate, even though they have some major differences. The prior system uses a lot of water but little or no electrical power, because it may be operated at municipal water pressure. The new fog system uses substantially less water, but usually uses electrical power to run the pump 32 for boosting the inlet water pressure in order to create and maintain a fully effective cloud of fog 36.

To reiterate, the fog system of the present invention is preferred for use because it permits the operator to control the ash by confining and precipitating it, without getting the lumber wet. It is imperative that the lumber not become substantially wet especially when the lumber is to be packaged rough and exported. (Usually it is necessary to process the lumber at 28 along the line from 26, through the planer mill to the packaging station 40, regardless of whether the lumber will actually be finished, because other operations are conducted on it along the line.) The sticks used for separating the courses of lumber during kilning must be separated out, the lumber must be graded and trimmed to length, inasmuch as it is overlength in the green stage so as to allow for maximum expected shrinkage during kilning. At the end of the line, the substantially dry lumber is packaged in proper sizes for shipment.

It should now be apparent that the water fog-type ash precipitator for a kilned lumber breakdown hoist as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. An improved timber processing system, comprising:

sawing timber to produce lumber and consequentially producing sawdust;

stacking the lumber in a multi-course pile with several generally parallel lengths in each course and at least some adjacent courses being spaced apart by a respective course of spacer sticks which run at generally right angles to the lengths of lumber in said adjacent courses;

placing the pile in a direct fired kiln;

collecting said sawdust and combusting the collected sawdust to produce an ash-laden hot gas stream, feeding the ash-laden hot gas stream to the kiln for kilning the lumber in said pile, whereby ash from the hot gas stream settles on the lumber during said kilning; and removing the pile of kilned lumber from the kiln and breaking down said pile course-by-course and serially placing each course on a feeding deck running to a downstream work station; and while breaking down the pile of kilned lumber course-by-course, atomizing a supply of water into a fog cloud enveloping said feeding deck adjacent said pile without substantially wetting the kilned lumber on the pile and feeding deck, said breaking down causing much of the ash which had settled onto said kilned lumber to be jarred loose and become airborne within said fog cloud, whereby atomized water in said fog cloud attaches to said airborne ash, causing at least a substantial proportion of said airborne ash to become so heavy as to precipitate to the floor.

2. For a timber processing system where a pile of kilned lumber stacked in courses is to be tilted and the kilned lumber permitted to fall therefrom onto a feeding deck successive course by successive course, beginning at the top of the pile, in an instance wherein, due to direct fired kilning of the lumber in the pile using an ash laden hot gas stream, the kilned lumber in the pile has a substantial amount of ash settled thereon, the improvement comprising:

creating a cloud of atomized water fog to envelope the site where the settled ash is disturbed and becomes airborne as the courses of kilned lumber fall from the pile, and thereby causing a substantial proportion of the airborne ash to settle on the floor.

3. The improved timber processing system of claim 2, wherein:

the fog cloud is created and maintained by atomizing water from a plurality of nozzles each atomizing water at a rate in the range from about 0.32 gallons per hour to about 1.36 gallons per hour at a water supply pressure in the range of about 60 p.s.i. to about 1000 p.s.i.

4. The improved timber processing system of claim 2, wherein:

so little water is sprayed onto and collected on the stacked and fallen kilned lumber, that upon being graded and cut to length, said kilned lumber is ready for packaging for shipment.

5. The improved timber processing system of claim 2, wherein:

the fog cloud is created and maintained by atomizing water from a plurality of fog nozzles aimed longitudinally of said system generally above the pile of kilned lumber, at a declining angle of about 45 degrees to the horizontal.

* * * * *